US010526937B2

(12) United States Patent
Ono et al.

(10) Patent No.: US 10,526,937 B2
(45) Date of Patent: Jan. 7, 2020

(54) BAFFLE PLATE FOR OIL PAN

(71) Applicant: HONDA MOTOR CO., LTD., Minato-ku, Tokyo (JP)

(72) Inventors: Takuya Ono, Wako (JP); Atsushi Suenaga, Wako (JP); Osamu Yoda, Tochigi (JP); Koichiro Asame, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/190,706

(22) Filed: Nov. 14, 2018

(65) Prior Publication Data

US 2019/0153917 A1 May 23, 2019

(30) Foreign Application Priority Data

Nov. 22, 2017 (JP) ..... 2017-224704

(51) Int. Cl.
*F01M 11/00* (2006.01)
*F02B 75/20* (2006.01)

(52) U.S. Cl.
CPC . *F01M 11/0004* (2013.01); *F01M 2011/0033* (2013.01); *F02B 75/20* (2013.01)

(58) Field of Classification Search
CPC ..... F01M 11/0004; F01M 2011/0033; F01M 2011/005; F02B 75/20
See application file for complete search history.

(56) References Cited

U.S. PATENT DOCUMENTS 4,270,497 A * 6/1981 Valerio ..... F01M 11/0004 123/195 C
5,960,763 A * 10/1999 Yamamura ..... F01M 11/0004 123/195 C
7,198,018 B2 * 4/2007 Kajiwara ..... F02F 7/0012 123/195 H
7,341,039 B1 * 3/2008 Jaszewski ..... F01M 11/0004 123/195 AC
8,020,528 B1 * 9/2011 Phillips ..... F01M 11/0004 123/192.1
9,399,935 B2 * 7/2016 Inoue ..... F01M 11/0004
2010/0132655 A1 * 6/2010 Wunsch ..... F01M 11/0004 123/196 R
2010/0139606 A1 * 6/2010 Yorita ..... F01M 11/0004 123/192.2
2012/0067319 A1 * 3/2012 Cygan, Jr. ..... F01M 11/0004 123/196 A

FOREIGN PATENT DOCUMENTS

JP 02211312 A * 8/1990 ..... F01M 11/00
JP 3552414 B2 8/2004
JP 4016932 B2 12/2007

* cited by examiner

*Primary Examiner* — Grant Moubry
(74) *Attorney, Agent, or Firm* — Armstrong Teasdale LLP

(57) ABSTRACT

A baffle plate includes a curved part which in turn includes a bottom portion (40), an upstream inclined portion (41), and a downstream inclined portion (42). A part of the downstream inclined portion adjacent to the bottom portion is provided with a first downstream through hole (49) elongated in the axial direction of the crankshaft, and a downstream side wall (50) extending from a downstream edge of the first downstream through hole in an upstream direction with respect to the rotational direction of the crankshaft, and a part of the downstream inclined portion remote from the bottom portion is provided with a plurality of second downstream through holes (52).

11 Claims, 4 Drawing Sheets

BAFFLE PLATE FOR OIL PAN

TECHNICAL FIELD

The present invention relates to a baffle plate provided in an upper part of an oil pan of an internal combustion engine.

BACKGROUND ART

In a conventional wet sump internal combustion engine, a baffle plate is provided in an upper part of an oil pan, and a bottom portion of the baffle plate is provided with a laterally elongated through hole. A slat extends from a downstream edge of the through hole toward the upstream side. See JP3552414B. This baffle plate allows the lubricating oil that is deposited on the upper surface of the baffle plate to be expelled to the oil reservoir in the oil pan via the through hole of the baffle plate by using the air flow created by the rotation of the crankshaft. However, this air flow impinges directly upon the surface of the oil in the oil reservoir via the through hole so that the oil may be aerated.

JP4016932B proposes to provide a through hole in a part of the baffle plate offset from the center thereof with an aim to avoid such an aeration.

However, the arrangement proposed by JP4016932B has the drawback that the oil cannot be expelled to the oil reservoir as promptly as desired.

SUMMARY OF THE INVENTION

In view of such a problem of the prior art, a primary object of the present invention is to provide a baffle plate for an oil pan which can avoid aeration of the lubricating oil but can promptly expel the lubricating oil to the oil reservoir in the oil pan.

To achieve such an object, the present invention provides a baffle plate (30) provided in an upper part of an oil pan (6) of an internal combustion engine (1), the baffle plate comprising a curved part (35) which is recessed downward as viewed in an axial direction of a crankshaft (16) of the engine, wherein the curved part includes: a bottom portion (40) extending substantially circumferentially around an axis of the crankshaft, and provided with a plurality of bottom through holes (44); an upstream inclined portion (41) continuously connected to an upstream end of the bottom portion with respect to a rotational direction of the crankshaft, and extending with a downward slant toward the bottom portion; and a downstream inclined portion (42) continuously connected to a downstream end of the bottom portion with respect to the rotational direction of the crankshaft, and extending with a downward slant toward the bottom portion, wherein a part of the downstream inclined portion adjacent to the bottom portion is provided with a first downstream through hole (49) elongated in the axial direction of the crankshaft, and a downstream side wall (50) extending from a downstream edge of the first downstream through hole in an upstream direction with respect to the rotational direction of the crankshaft, and wherein a part of the downstream inclined portion remote from the bottom portion is provided with a plurality of second downstream through holes (52).

Thereby, the oil that has deposited on the upper surface of the baffle plate can be promptly expelled to the oil pan via the first downstream hole by making use of an air flow created by the rotation of the crankshaft. Since the first downstream hole is provided in the downstream inclined portion, and is fitted with the downstream side wall, the air flow that has passed through the first downstream hole impinges upon the surface of the oil in the oil pan at a shallow angle so that the air flow is prevented from penetrating the oil, and the oil is prevented from being aerated. The oil that has been blown or otherwise forced beyond the first downstream hole along the upper surface of the downstream inclined portion is expelled to the oil pan via the second downstream through holes.

Preferably, at least one of the second downstream through holes aligns with the downstream side wall with respect to the rotational direction of the crankshaft.

Thereby, the oil that has advanced beyond the first downstream hole along the upper surface of the downstream inclined portion is expelled to the oil pan via the second downstream through holes in a favorable manner.

Preferably, the downstream side wall is smaller in width than the downstream inclined portion with respect to the axial direction of the crankshaft.

Thereby, the oil can flow from the downstream inclined portion to the bottom portion along at least one side of the downstream side wall.

Preferably, the downstream side wall extends substantially horizontally.

Thereby, the air that is blown through the first downstream hole is directed substantially horizontally so that the air flow is prevented from penetrating the oil in the oil pan in an even more effective manner.

Preferably, the downstream inclined portion, the bottom portion and the upstream inclined portion extend concentrically around the axis of the crankshaft.

Thereby, the baffle plate can be brought close to the crankshaft without causing a contact therebetween so that the size of the engine can be minimized. Alternatively, the downstream inclined portion and the upstream inclined portion may extend substantially linearly and tangentially from the downstream end and the upstream end of the bottom portion, respectively.

Preferably, the second downstream through holes have a greater opening area than the bottom through holes.

Thereby, the oil can be expelled from the baffle plate in a most effective manner while the aeration of the oil can be minimized.

According to a preferred embodiment of the present invention, the engine includes at least two cylinders (10) arranged in a cylinder row along the axis of the crankshaft, and the crankshaft is supported by bearings (17) provided at ends of the cylinder row and between the adjoining cylinders, and the curved part further includes partition walls (36) and end walls (37) each extending upward and orthogonally to the axis of the crankshaft in a part of the curved part corresponding to the corresponding bearing, the curved part being defined between the end walls and separated into different regions by the partition walls.

The partition walls and the end walls increase the stiffness of the baffle plate.

Preferably, lateral edges of the downstream side wall are each spaced from the opposing partition wall or the opposing end wall to create a gap (51) therebetween.

Thereby, the oil can flow freely along the upper surface of the baffle plate via the gaps created between the lateral edges of the downstream side wall and the opposing partition walls or the opposing end walls.

Preferably, a part of the upstream inclined portion adjacent to the bottom portion is provided with a first upstream through hole (59) elongated in the axial direction of the crankshaft, and an upstream side wall (60) extending from a downstream edge of the first upstream through hole in an upstream direction with respect to the rotational direction of the crankshaft.

Thereby, the oil can be expelled also from the upstream part of the baffle plate in a favorable manner.

Preferably, a flange (32) for fastening the baffle plate to a cylinder block (5) of the engine extends along a peripheral part of the curved part.

Thereby, the fastening of the baffle plate to the cylinder block is facilitated, and the stiffness of the baffle plate can be enhanced.

The present invention thus provides a baffle plate for an oil pan which can avoid aeration of the lubricating oil but can promptly expel the lubricating oil to the oil reservoir in the oil pan.

BRIEF DESCRIPTION OF THE DRAWING(S)

DETAILED DESCRIPTION OF THE INVENTION

A baffle plate for an oil pan of an internal combustion engine according to a first embodiment of the present invention is described in the following with reference to FIGS. 1 to 3. In the following description, the terms "downstream" and "upstream" are used in regard to the air flow created by the rotation of the crankshaft, and this also corresponds to the direction of the movement of the lower part of the crankshaft.

Figure 1:
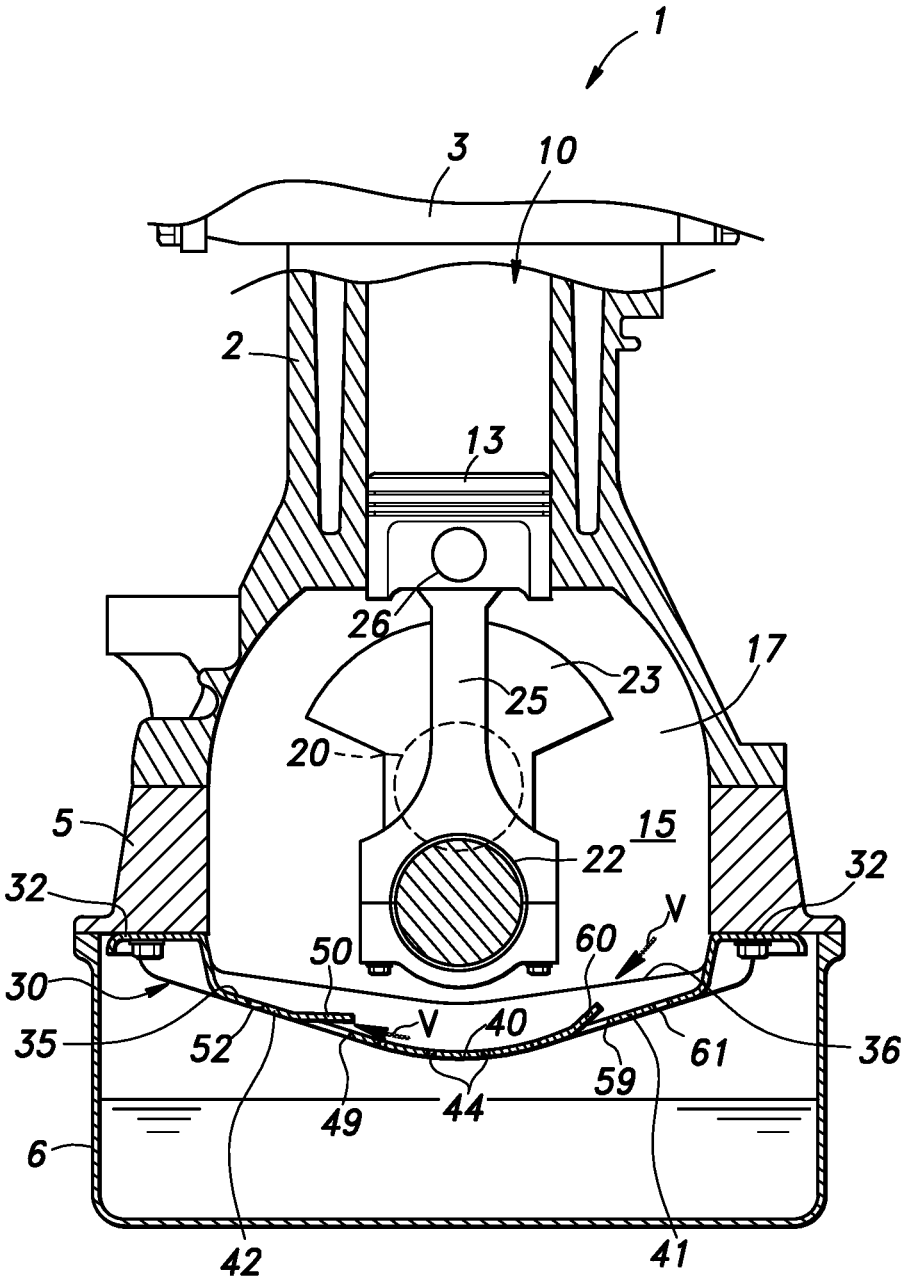
FIG. 1 is a sectional front view of an internal combustion engine according to a first embodiment of the present invention.
Figure 2:
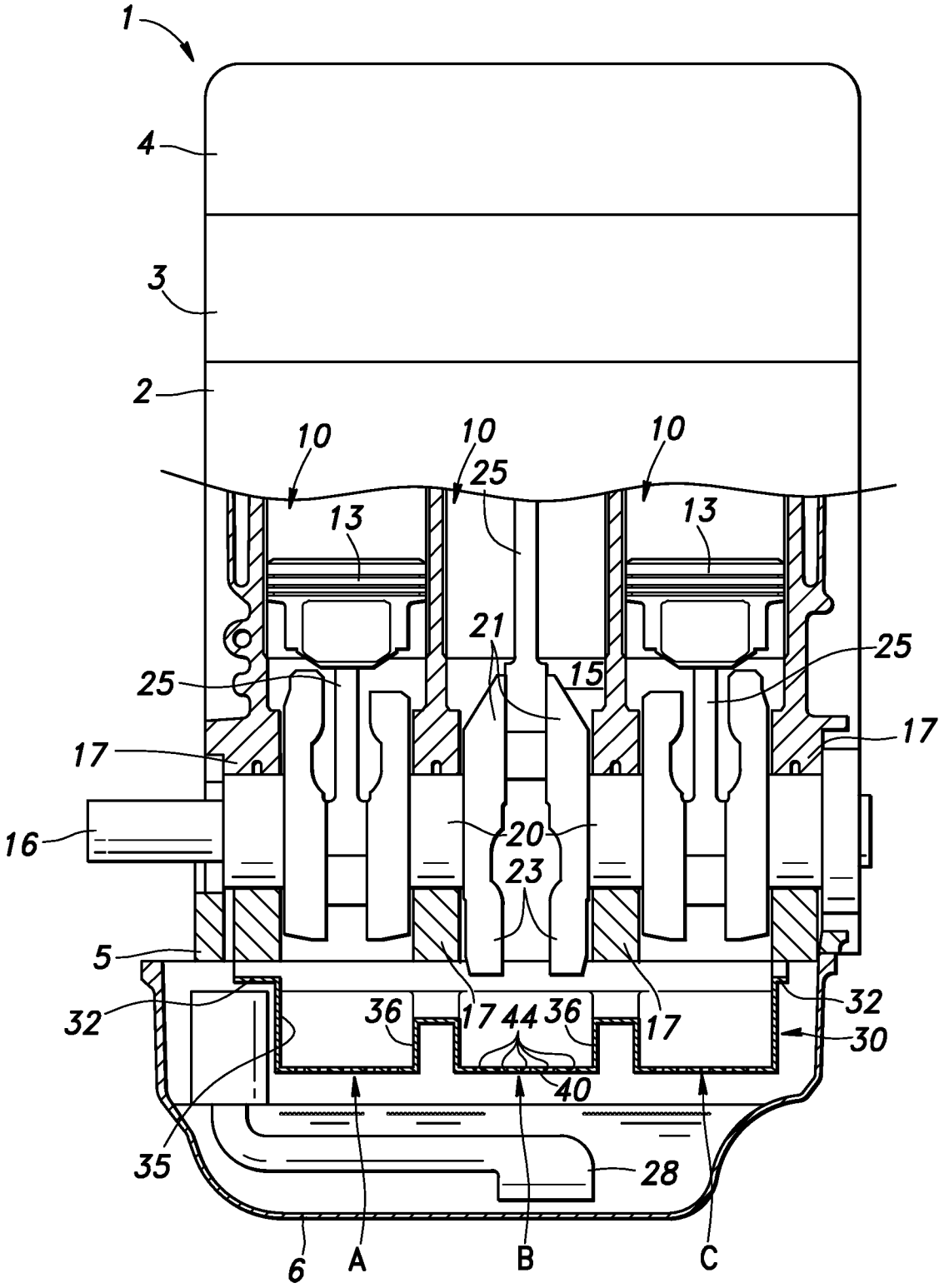
FIG. 2 is a sectional side view of the internal combustion engine.

As shown in FIGS. 1 and 2, the internal combustion engine 1 consists of an in-line three cylinder reciprocating engine, and includes an upper block 2, a cylinder head 3 connected to the upper end of the upper block 2, a head cover 4 connected to the upper end of the cylinder head 3, a lower block 5 connected to the lower end of the upper block 2, and an oil pan 6 connected to the lower end of the lower block 5. The upper block 2 and the lower block 5 jointly form a cylinder block.

As shown in FIG. 2, three cylinders 10 are defined in the cylinder block, and are arranged in a cylinder row direction (extending horizontally). The cylinders 10 extend substantially vertically, but the axes of the cylinders 10 may be inclined with respect to the vertical direction. A piston 13 is slidably received in each cylinder 10.

A lower part of the upper block 2 and the lower block 5 jointly define a crank chamber 15 which opens downward. In the crank chamber 15, a crankshaft 16 is rotatably supported by a plurality of bearings 17 provided between the upper block 2 and the lower block 5.

The crankshaft 16 is provided with four journals 20 supported by the respective bearings 17, three crank pins 22, and three pairs of webs 21 each pair connecting the corresponding crank pin 22 to the adjoining journals. Each web 21 is provided with a counterweight 23. Each crank pin 22 is connected to the big end of a corresponding connecting rod 25, and the small end of the connecting rod 25 is connected to the corresponding piston 13 via a piston pin 26 in a per se known manner.

The oil pan 6 is shaped as a box having an open top. The oil pan 6 is fastened to the lower end of the lower block 5 to close the lower end of the crank chamber 15. An oil reservoir for lubricating oil is formed in the oil pan 6. Inside the oil pan 6, a suction pipe 28 for feeding lubricating oil to an oil pump (not shown in the drawings) is provided. The suction pipe 28 has a suction port in a lower end thereof, and is internally provided with an oil filter.

As shown in FIG. 1, a baffle plate 30 is provided in an upper part of the oil pan 6. The baffle plate 30 is formed by stamp forming sheet metal such as steel plate. A flange 32 extends substantially horizontally along the outer peripheral edge of the baffle plate 30. The baffle plate 30 is fastened to the lower end of the lower block 5 via this flange 32.

A curved part 35 recessed downward with respect to the flange 32 is formed in the central part of the baffle plate 30. As shown in FIG. 2, the curved part 35 extends conformally in the axial direction of the crankshaft 16, and presents a concave side facing upward as viewed in the axial direction. In other words, the curved part 35 defines a substantially semi-cylindrical shape.

Figure 3:
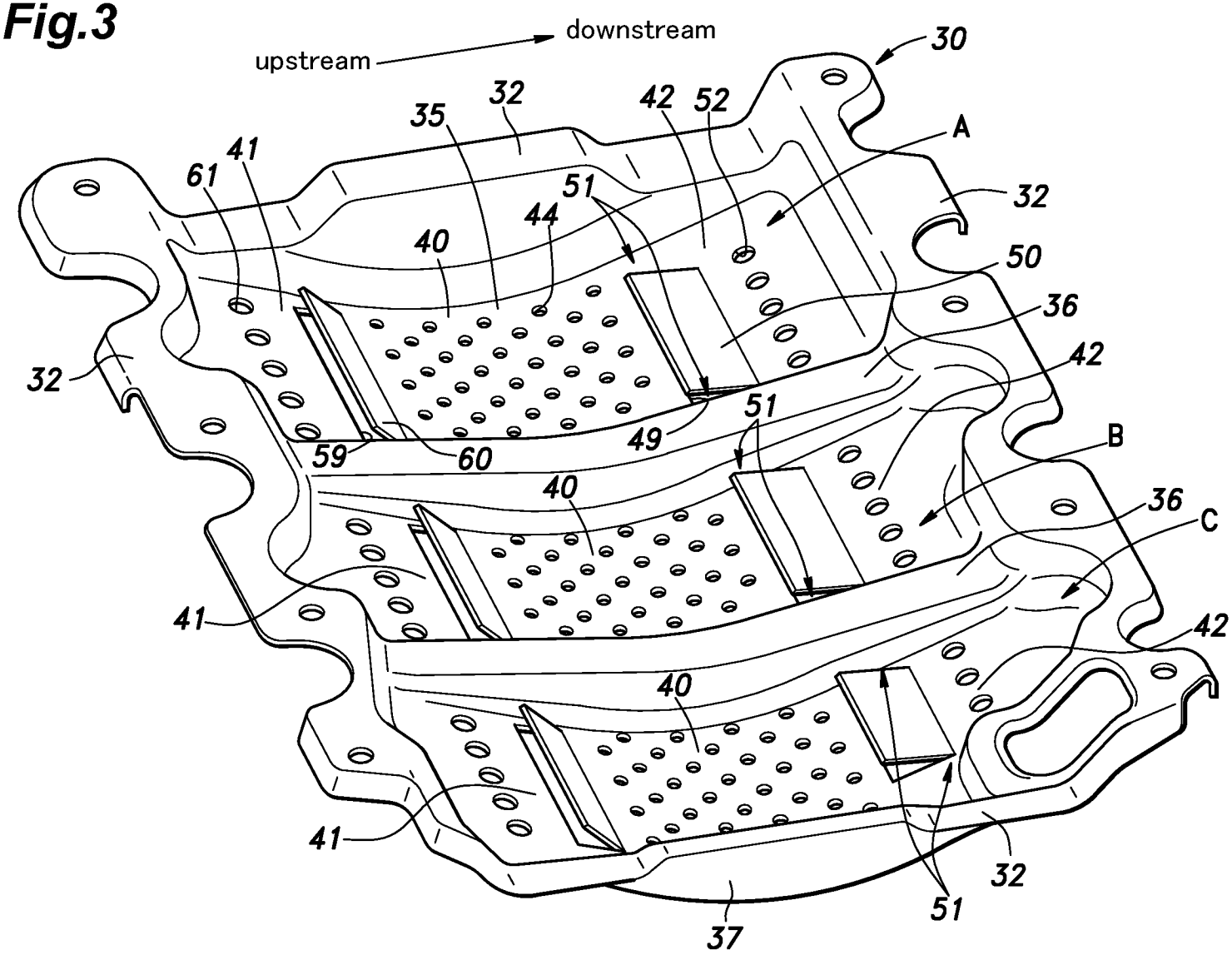
FIG. 3 is a perspective view of a baffle plate of the first embodiment.

As shown in FIG. 3, the curved part 35 is separated by two partition walls 36 projecting upward and extending in a direction orthogonal to the axis of the crankshaft 16. The axial ends of the curved part 35 is limited by end walls 37 also extending in a direction orthogonal to the axis of the crankshaft 16. The curved part 35 is separated into three parts A, B and C having a substantially same axial length.

Each of the partition walls 36 is formed by bulging the material of the baffle plate 30 upward so that the lower side of the partition wall 36 forms a concave portion which opens downward. The end walls 37 are formed by bending the material of the baffle plate 30 upward, and are substantially conformal to the partition walls 36 when viewed in the axial direction. As shown in FIG. 2, each partition wall 36 is positioned under the corresponding bearing 17 or, in other words, the partition walls 36 are positioned so as to correspond to the respective bearings 17. The end walls 37 are positioned under the outermost bearings 17, respectively, or, in other words, the end walls 37 are positioned so as to correspond to the outermost bearings 17, respectively. Each of the regions A to C is arranged under the corresponding cylinder 10. The partition walls 36 and the end walls 37 increase the stiffness of the baffle plate 30.

Each region A to C of the curved part 35 has a bottom portion 40 that extends circumferentially around the axis of the crankshaft 16 and defines a lower most part of the curved part 35, an upstream inclined portion 41 provided continuously on the upstream side of the bottom portion 40, and a downstream inclined portion 42 provided continuously on the downstream side of the bottom portion 40. The upstream inclined portion 41 and the downstream inclined portion 42 are each inclined downward toward the bottom portion 40. In other words, the upstream inclined portion 41 is inclined downward toward the downstream side and the downstream inclined portion 42 is inclined downward toward the upstream side. The upstream inclined portion 41, the bottom portion 40, and the downstream inclined portion 42 are preferably formed in an arc shape centered around the axis of the crankshaft 16. Alternatively, the downstream inclined portion 42 and the upstream inclined portion 41 extend substantially linearly and tangentially from the downstream end and the upstream end of the bottom portion 40, respectively.

As shown in FIG. 3, a plurality of bottom through holes 44 are passed through the baffle plate 30 in the thickness-wise direction in each bottom portion 40. It is preferable that the bottom through holes 44 are arranged evenly over the entire bottom portion 40. In the illustrated embodiment, the bottom through holes 44 are formed in multiple rows in a staggered relationship.

A substantially rectangular first downstream through hole 49 elongated in the lateral direction is passed through a lower part of the downstream inclined portion 42 or a part of the downstream inclined portion 42 adjoining the bottom portion 40 in the thickness-wise direction, and a downstream side wall 50 consisting of a slat extends from the downstream edge of the first downstream through hole 49 in the upstream direction. The first downstream through hole 49 and the downstream side wall 50 are formed by cutting a rectangular area of the downstream inclined portion 42 along three sides, and raising this rectangular area. As shown in FIG. 1, the downstream side wall 50 is inclined upward with respect to the downstream inclined portion 42. However, the downstream side wall 50 may also extend horizontally or with a slight downward slant toward the downstream end thereof.

As shown in FIG. 3, the downstream side wall 50 is somewhat shorter in the lateral dimension thereof than the width of the downstream inclined portion 42 (or the distance between the associated partition walls 36 or the distance between one of the end walls 37 and the opposing partition wall 36), and is centrally located in the downstream inclined portion 42 with respect to the widthwise direction so that the lateral edges of the downstream side wall 50 are each spaced from the opposing partition wall or the opposing end wall. As a result, a gap 51 is created between each lateral edge of the downstream side wall 50 and the opposing partition wall 36 or end wall 37. In other words, a passage extending in the slanting direction of the downstream inclined portion 42 is created on either side of the downstream side wall 50.

A plurality of second downstream through holes 52 are passed through a part of each downstream inclined portion 42 downstream of the first downstream through hole 49. In this case, the second downstream through holes 52 are arranged laterally in a single row. At least one of the second downstream through holes 52 aligns with the downstream side wall 50 with respect to the upstream-downstream direction. In the illustrated embodiment, all or most of the second downstream through holes 52 align with the downstream side wall 50. The total opening area of the second downstream through holes 52 is greater than that of the bottom through holes 44. In an alternate embodiment of the present invention, the second downstream through holes 52 are arranged laterally in multiple rows.

A substantially rectangular first upstream through hole 59 elongated in the lateral direction is passed through a lower part of the upstream inclined portion 41 or a part of the upstream inclined portion 41 adjoining the bottom portion 40 in the thickness-wise direction, and an upstream side wall 60 consisting of a slat extends from the downstream edge of the first upstream through hole 59 in the upstream direction. The first upstream through hole 59 and the upstream side wall 60 are formed by cutting a rectangular area of the upstream inclined portion 41 along three sides, and raising this rectangular area. As shown in FIG. 1, the upstream side wall 60 is inclined upward with respect to the upstream inclined portion 41.

A plurality of second upstream through holes 61 are passed through a part of each upstream inclined portion 41 upstream of the first upstream through hole 59. In this case, the second upstream through holes 61 are arranged laterally in a single row. At least one of the second upstream through holes 61 aligns with the upstream side wall 60 with respect to the upstream-downstream direction. In the illustrated embodiment, all or most of the second upstream through holes 61 align with the upstream side wall 60. The total opening area of the second upstream through holes 61 is greater than that of the bottom through holes 44. In an alternate embodiment of the present invention, the second upstream through holes 61 are arranged laterally in multiple rows.

The advantages of the baffle plate 30 configured as described above are discussed in the following. The lubricating oil used for lubricating the cylinders 10 and the bearings 17 and for cooling the piston 13 drops onto the upper surface of the curved part 35 of the baffle plate 30. The oil that is collected on the upper surface of the curved part 35 of the baffle plate 30 drops into the oil reservoir of the oil pan 6 via the bottom through holes 44, the first downstream through hole 49, the second downstream through holes 52, the first upstream through hole 59, and the second upstream through holes 61.

As the crankshaft 16 rotates, an air flow V directed in the same direction as the lower part of the crankshaft 16 is created along the upper surface of the baffle plate 30 as shown in FIG. 1. A part of the air flow V is guided by the lower surface of the downstream side wall 50, passes through the first downstream through hole 49, and flows onto the oil stored in the oil pan 6. At this time, the lubricating oil adhering to the lower surface of the downstream side wall 50 and deposited around the first downstream through hole 49 passes through the first downstream through hole 49 by being entrained by the air flow V, and is expelled to the oil pan 6. Since the air flow V guided by the lower surface of the downstream side wall 50 impinges upon the surface of the oil stored in the oil pan 6 at a shallow angle, the air flow V is prevented from penetrating into the oil, and is hence prevented from being aerated.

The lubricating oil adhering to the upper surface of the downstream inclined portion 42 is expelled from the second downstream through holes 52 to the oil reservoir of the oil pan 6. A part of the lubricating oil adhering to the upper surface of the downstream inclined portion 42 flows through the gaps 51 to the bottom portion 40, and is expelled to the oil pan 6 via the bottom through holes 44. The second downstream through holes 52 and the gaps 51 can prevent the oil from staying on the upper surface of the downstream inclined portion 42, or above the downstream side wall 50.

The second downstream through holes 52 are located farther from the oil surface of the lubricating oil in the oil pan 6 than the bottom through holes 44 so that the air flow V passing through the second downstream through holes 52 is attenuated before reaching the oil level more than the air flow V passing through the bottom through holes 44, and hence causes little influence on the oil surface of the lubricating oil in the oil pan 6. Therefore, by making the second downstream through holes 52 greater in the total opening area than the bottom through holes 44, it is possible to promptly expel the lubricating oil to the oil pan 6 while suppressing the aeration of the oil. Further, by making the bottom through holes 44 smaller in the total opening area than the second downstream through holes 52, the air flow V passing through the bottom through holes 44 is effectively prevented from causing aeration.

Since the first upstream through hole 59 is provided in a lower part of the upstream inclined portion 41 which is remote from the oil surface, the air flow V passing through the first upstream through hole 59 attenuates to such an extent before reaching the oil surface so that aeration of the oil can be avoided. The lubricating oil adhering to the upper surface of the upstream inclined portion 41 can flow through the second upstream through holes 61 to the oil pan 6 so that the lubricating oil is prevented from being kept deposited on the upper surface of the upstream inclined portion 41.

Figure 4:
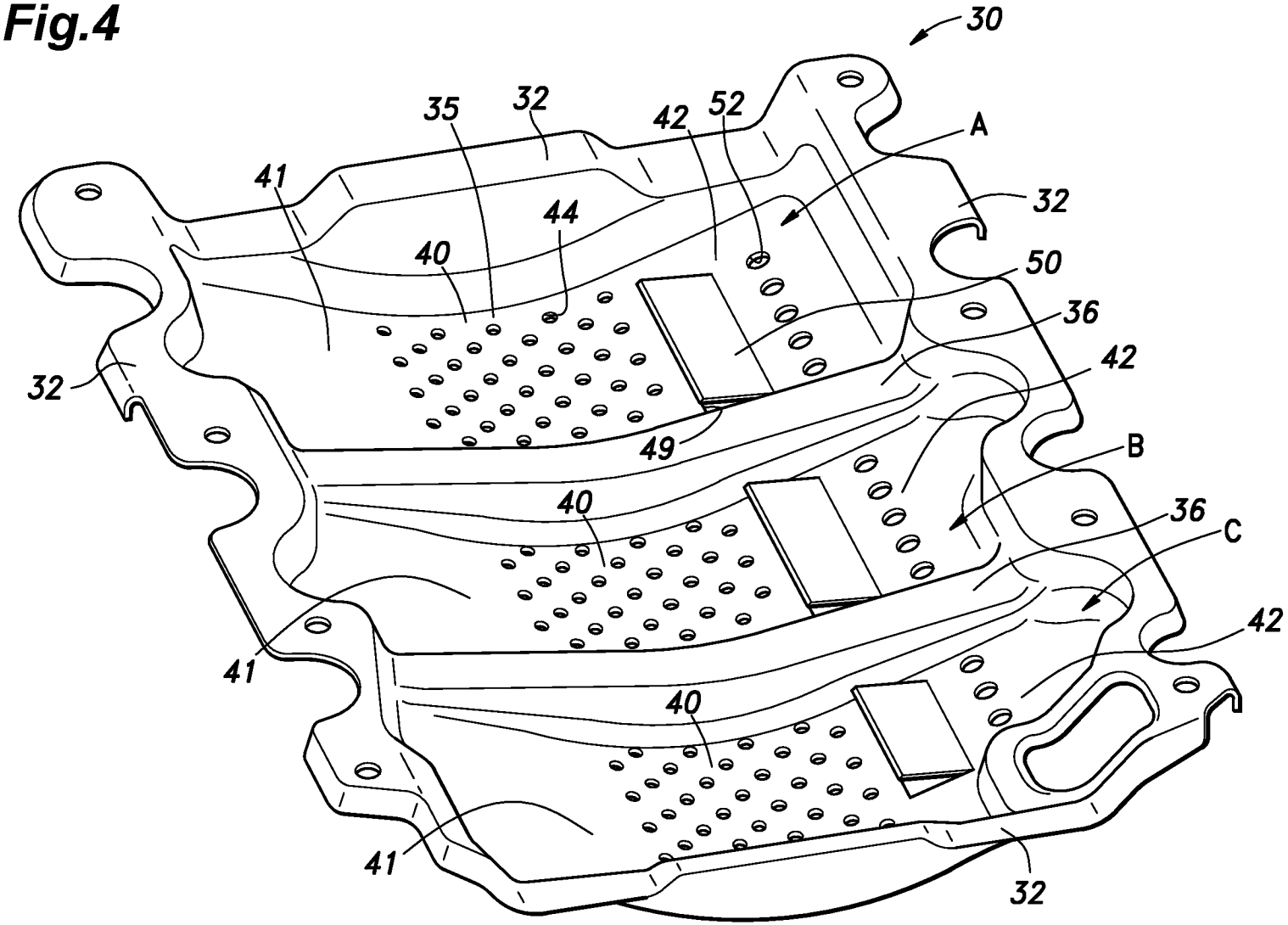
FIG. 4 is a perspective view of a baffle plate of a second embodiment.

Although the present invention has been described in terms of a specific embodiment, the present invention is not limited by such an embodiment, but the various components of the present invention can be modified and substituted without departing from the spirit of the present invention. For instance, as shown in FIG. 4, the first upstream through hole 59 and the second upstream through holes 61 may be omitted.

Further, the bottom portion 40, the upstream inclined portion 41 and the downstream inclined portion 42 of the baffle plate 30 may be generally planar or curved in different ways. It is also possible to provide a plurality of first downstream through holes 49 and/or a plurality of first upstream through holes 59 instead of a single first downstream through hole 49 and/or a single first upstream through hole 59 in each of the regions A to C.

The invention claimed is:

1. A baffle plate provided in an upper part of an oil pan of an internal combustion engine, the baffle plate comprising a curved part which is recessed downward as viewed in an axial direction of a crankshaft of the engine, wherein the curved part includes:

a bottom portion extending substantially circumferentially around an axis of the crankshaft, and provided with a plurality of bottom through holes;

an upstream inclined portion continuously connected to an upstream end of the bottom portion with respect to a rotational direction of the crankshaft, and extending with a downward slant toward the bottom portion; and a downstream inclined portion continuously connected to a downstream end of the bottom portion with respect to the rotational direction of the crankshaft, and extending with a downward slant toward the bottom portion, wherein a part of the downstream inclined portion adjacent to the bottom portion is provided with a first downstream through hole elongated in the axial direction of the crankshaft, and a downstream side wall extending from a downstream edge of the first downstream through hole in an upstream direction with respect to the rotational direction of the crankshaft, and wherein a part of the downstream inclined portion remote from the bottom portion is provided with a plurality of second downstream through holes.

2. The baffle plate according to claim 1, wherein at least one of the second downstream through holes aligns with the downstream side wall with respect to the rotational direction of the crankshaft.

3. The baffle plate according to claim 1, wherein the downstream side wall is smaller in width than the downstream inclined portion with respect to the axial direction of the crankshaft.

4. The baffle plate according to claim 1, wherein the downstream side wall extends substantially horizontally.

5. The baffle plate according to claim 1, wherein the downstream inclined portion, the bottom portion and the upstream inclined portion extend concentrically around the axis of the crankshaft.

6. The baffle plate according to claim 1, wherein the second downstream through holes have a greater opening area than the bottom through holes.

7. The baffle plate according to claim 1, wherein the engine includes at least two cylinders arranged in a cylinder row along the axis of the crankshaft, and the crankshaft is supported by bearings provided at ends of the cylinder row and between the adjoining cylinders, and the curved part further includes partition walls and end walls each extending upward and orthogonally to the axis of the crankshaft in a part of the curved part corresponding to the corresponding bearing, the curved part being defined between the end walls and separated into different regions by the partition walls.

8. The baffle plate according to claim 7, wherein lateral edges of the downstream side wall are each spaced from the opposing partition wall or the opposing end wall to create a gap therebetween.

9. The baffle plate according to claim 1, wherein a part of the upstream inclined portion adjacent to the bottom portion is provided with a first upstream through hole elongated in the axial direction of the crankshaft, and an upstream side wall extending from a downstream edge of the first upstream through hole in an upstream direction with respect to the rotational direction of the crankshaft.

10. The baffle plate according to claim 1, wherein a flange for fastening the baffle plate to a cylinder block of the engine extends along a peripheral part of the curved part.

11. The baffle plate according to claim 1, wherein the downstream inclined portion and the upstream inclined portion extend substantially linearly and tangentially from the downstream end and the upstream end of the bottom portion, respectively.

* * * * *